United States Patent [19]

Benes et al.

[11] 4,229,300

[45] Oct. 21, 1980

[54] PROCESS FOR THE REMOVAL OF RADIOACTIVE IODINE FROM A LIQUID, ESPECIALLY URINE, AND APPARATUS TO CARRY OUT THE PROCESS

[76] Inventors: Ivan Benes, Müllerwis 23, 8606 Greifensee; Wolfgang Müller-Duysing, Niederweg 42, 8907 Wettswil; Fritz Heinzel, Lindenweg 8, 8142 Uitikon, all of Switzerland

[21] Appl. No.: 931,586

[22] Filed: Aug. 7, 1978

Related U.S. Application Data

[62] Division of Ser. No. 759,522, Jan. 14, 1977, abandoned.

[30] Foreign Application Priority Data

Jan. 14, 1976 [CH] Switzerland ..... 430/76

[51] Int. Cl.[2] ..... C02C 1/40

[52] U.S. Cl. ..... 210/96.1; 210/104; 210/106; 210/206; 210/219

[58] Field of Search ..... 210/85, 86, 96.9, 101, 210/102, 104, 202, 206, 208, 152, 219

[56] References Cited

U.S. PATENT DOCUMENTS

| | | | |
|---|---|---|---|
| 2,988,221 | 6/1961 | Culp | 210/104 |
| 3,325,401 | 6/1967 | Lancy | 210/206 X |
| 3,415,377 | 12/1968 | Higgins | 210/96 R |
| 3,459,947 | 8/1969 | Cropper | 210/96 R |
| 3,679,053 | 7/1972 | Koulovatos et al. | 210/104 X |
| 3,920,550 | 11/1975 | Farrell et al. | 210/104 X |
| 3,965,006 | 6/1976 | Otte, Jr. | 210/152 X |

*Primary Examiner*—John Adee

*Attorney, Agent, or Firm*—Sughrue, Rothwell, Mion, Zinn and Macpeak

[57] ABSTRACT

Apparatus for removing radioactive iodine from a liquid, especially urine, having a collecting means, a treating tank with a mixer-pump, a filter, and a catch basin in which radiation is detected. The apparatus includes various control means and magnetic values to provide automatic operation.

10 Claims, 1 Drawing Figure

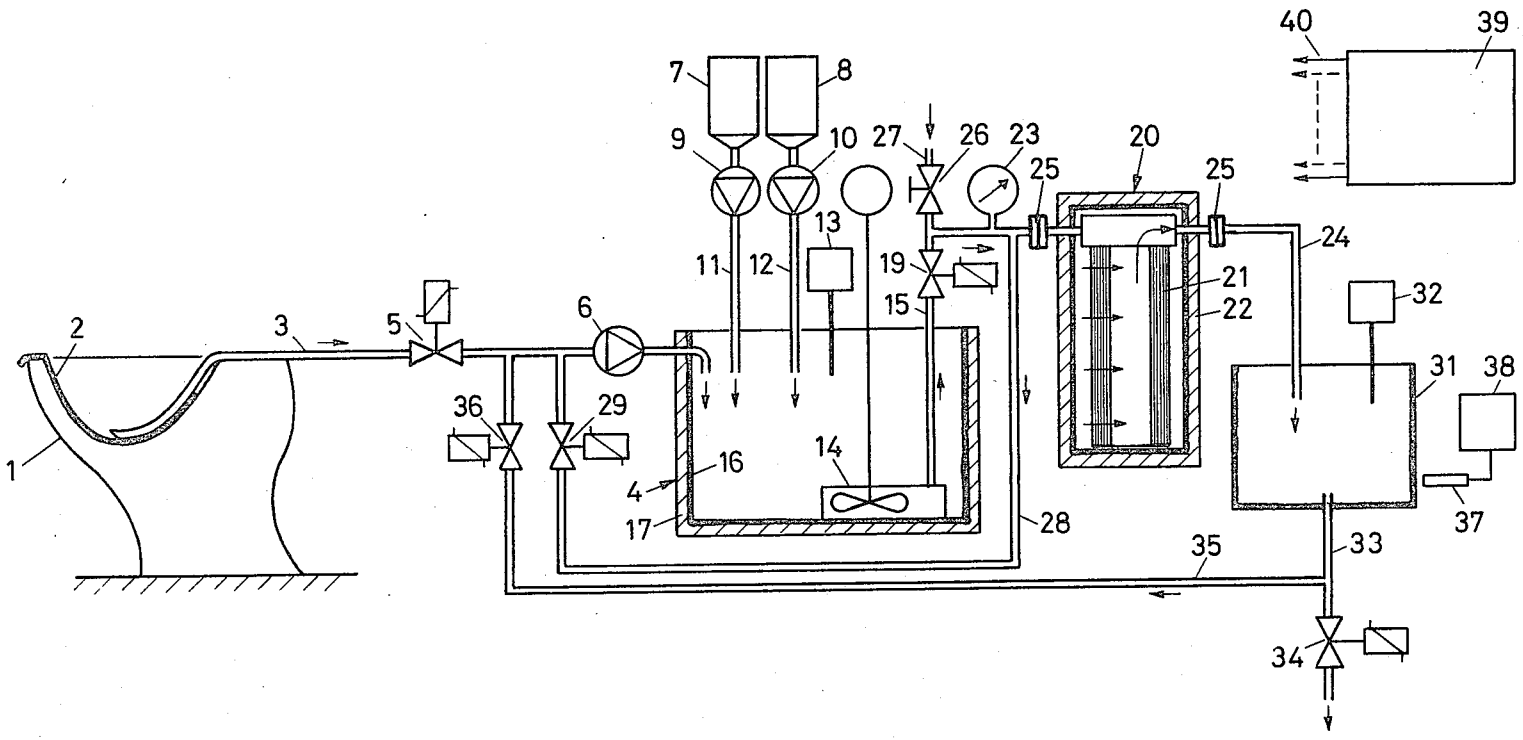
39
40
38
37
32
31
33
34
24
25
21
22
20
35
25
23
28
26
27
19
15
8
10
13
14
12
7
9
11
16
4
17
6
29
36
5
3
2
1

PROCESS FOR THE REMOVAL OF RADIOACTIVE IODINE FROM A LIQUID, ESPECIALLY URINE, AND APPARATUS TO CARRY OUT THE PROCESS

This is a divisional application of application Ser. No. 759,522, filed Jan. 14, 1977, now abandoned.

BACKGROUND OF THE INVENTION

The $^{131}$J-radioactive iodine has been used for some time routinely and with good success for the therapy of many thyroid complaints. The patient is given $^{131}$J-iodine, sometimes $^{125}$J-iodine, in the form of a carrier free iodide in activities of a few mCi up to 300 mCi at one time as a radioactive therapy. Dependent on the storing of the thyroid tissue, of the primary thyroid tumor or of the distant metastases in case of the thyroid carcinoma, and depending on the iodinations, iodization and incretion of the thyroid gland, a more or less large part of radioactive iodine given is excreted as inorganic iodide or organically bound iodine (L-triiodine thyronine, L-thyroxine, mono iodine and di iodine thirosine or on plasmatic proteines) by the renal manner. The $^{131}$J-iodine activities, which are secreted via the salivary glands and stomach secretion, are partly re-absorbed in the ileum and partly secreted with the stool. The radioactive iodine secretions by the stool is very small as compared to the renal eliminations. The radioactive iodine excretion by way of the kidneys is within the range of 50∝70%, in case of the thyroid metasteases even up to 83% of the administered activity in 48 hours. On the other hand, the excretion of radioactive iodine in the stool amounts to a maximum of 6% of the applied activity. According to measurements, the total excretion of radioactive iodine via the kidneys, depending on the thyroid gland situation, lies within the range between 70–90% of the applied activity.

The radioactive iodine urine excretion depends indirectly on the iodination and directly on the iodization or incretion of the thyroid gland. It also depends on these processes whether the iodine is excreted in an inorganic form or organically bound via the urine. In case of an increased iodine storage as happens in case of therapy of thyroid carcinoma-distant metastases after thyroid elimination, the percentage of the radioactive iodine excretion is very high and reaches almost 90% of the applied activity in 48 hours. The excreted iodine is present in the form of inorganic iodine. On the contrary, in case of hyperthyrotoxicoses and toxic adenoma, the radioactive iodine adsorption is accelerated and thus the excretion of the administered radioactive iodine is essentially decreased. In the first 48 hours only 17 to a maximum of 30% of the inorganic iodine is eliminated. The further excretion of radioactive iodine takes place on a delayed basis. On the basis of the higher and accelerated metabolism, the radioactive iodine is present partly also organically bound in triiodine thyronine, thyroxine, mono and di iodine thyronine or in plasmatic proteins.

It was found by means of whole body measurements of patients with thyroid malignancies under radioactive iodine therapy, that 87–90% of the applied activity is excreted in 48 hours at the latest in 72 hours. The total excretion amounts then in 5 days to 98–99.5%.

Very high activities of averagely 100–200 mCi must be administered at one time in case of patients with thyroid malignancies as a therapy. That means that in the first 2–3 days 80–180 mCi of $^{131}$J-iodine are eliminated from the patient's body through the kidneys. Such urine activities are considerably above the values which according to the radiation protection regulations are permitted to be delivered into the public canalization. There are only very few nuclear medical clinics with special lavatories with their own insulated monitored flushing systems and fade-away tank, suitable for the collection of radio-nuclides. The only other legal possibility lies in collecting the individual portions of highly radioactive excretions and their storage in a fade-away space at least for 10 half value times (=80 days). At the same time, there always is a serious danger for the nursing personnel because of charges of radiation. Moreover, in the case of this process contamination of individuals, rooms and apparatuses are very difficult to avoid, besides a very cumbersome task with human excretions. The storage of the highly active secretions moreover produces conservation problems for the prevention of fermentation processes. In many places, the collection and storage of radioactive excretions is completely passed over and the patient is permitted to use standard lavatories. As a result, every day hundreds of millicurie of $^{131}$J-iodine activities are discharged daily into the sewage on the basis of medical use.

In order to avoid the unpleasant manipulation and storage of highly active urine, a process has become known which is based on the binding of the radioactive iodine to an ion exchanger. This process, which at first glance seems simple and plausible, has however a few unacceptable disadvantages in case of its practical execution:

(1) The ion exchanger loses its ability of exchanging the $^{131}$J-iodine fairly soon; the ion exchanger cartridges must therefore be replaced often.

(2) The ion exchanger column is plugged up by the inorganic and organic substances and micro-particles present in the urine even in case of use of a coarse-grained ion exchanger, so that the urine will soon only flow by drops through the column.

(3) The regeneration of an ion exchanger is not meaningful because of the enrichment of the separation column with highly radioactive $^{131}$J-iodine. Thus, this process is fairly expensive because of the relatively high price of the ion exchanger and also quite costly because of the frequent replacement of the cartridge (3 to 4 times per patient in case of an average volume of urine of 200 ml).

(4) Iodine is caught selectively only in the organic form, for example, as iodide or iodade. The organically bound iodine can not be separated with this process. That means that even beginning with four days, more than 15% of the radioactive iodine will flow through the ion exchanger column.

All hitherto used processes for the removal of the radioactive iodine from the urine are cumbersome, constitute a potential danger for additional charge by radiations of the nursing personnel or have a lower and uncertain yield.

It is the task of the present invention to create a process for the removal of radioactive iodine from a liquid, especially from urine, which can be executed in a simple and continuous manner without contaminations of persons, rooms and apparatuses, which furthermore has a reliable and high yield and which produces a solid, compact and correspondingly small volume of radioactive substance which may be stored radiation-safe easily and without danger up to the fading away of the radioactivity.

Another task of the present invention consists in creating an arrangement, by means of which the above mentioned process may be carried out automatically without manual intervention.

According to the invention, the process for the removal of radioactive iodine from a liquid, especially from urine, is characterized in that a predetermined quantity of the liquid free of solids, and containing the radioactive iodine is collected in continuously successive processing steps, in that always a dosed quantity of at least a first reaction solution containing a carrier substance for the radioactive iodine and of a second reaction solution, containing a salt of a heavy metal is fed to this quantity of liquid, in that the fed-in reaction solutions are mixed with the liquid during a predetermined time for the formation of an insoluble, radioactive precipitate, in that the liquid containing the radioactive precipitate as a suspension is filtered in order to separate the radioactive precipitate from the liquid, and in that the liquid, freed at least approximately of radioactive components, is collected for the purpose of discharge into a canalization system, whereby these processing steps are carried out in an automatic course.

The arrangement for carrying out the process has been characterized according to the invention by a reaction chamber equipped with a suction line for the liquid containing radioactive iodine, which chamber has a level sensor, a mixing apparatus and a pressure pump for conveying of the liquid located in the reaction chamber, into the outlet line, and to which at least two tanks for the reaction solutions, equipped always with a dosing arrangement, have been assigned, by a filtration unit, connected releasably to the output line of the reaction chamber, the liquid-output line of which leads to collecting tank having an outlet, the outlet of which may be connected with the canalization system via a discharge valve, and by a programmable, electric control unit, the control inlets or outlets of which are connected with the level sensor, the mixing arrangement, the pressure pump and the dosing arrangements of the reaction chamber as well as with the discharge valve of the collecting tank.

BRIEF DESCRIPTION OF THE DRAWING

Embodiments of the invention will be explained subsequently on the basis of an arrangement—shown schematically in the sole FIGURE of the attached drawing—for the removal of radioactive iodine from the urine of a patient and for discharge of the urine freed of radioactive iodine into the canalization.

DESCRIPTION OF THE PREFERRED EMBODIMENT

The arrangement, shown in the drawing, comprises an insert 2, insertable into the customary lavatory bowl 1, which insert itself has the shape of the bowl and consists, for example, of plastic. The insert only covers the front part of the lavatory bowl and serves for collecting the radioactive urine of the patient using the lavatory while the feces reach the canalization via the rear part of the lavatory bowl, which is not covered up. In order to suck off the urine from the insert and for the subsequent removal of the radioactive iodine from the urine, a pipeline 3 has been guided into the insert 2 up to its bottom. the pipeline 3 has at its end lying close to the bottom of the insert 2, small apertures, not shown, or a sieve, which only permit the passage of the liquid urine but in any case hold back any feces reaching the insert.

Naturally, a properly developed lavayory bowl may be used instead of the insert 2, which may be placed on the customary lavatory bowl 1, from which the urine may not reach the canalization. If the patient discharges only urine, as may be the case with males, then some other container intended for the reception of urine may also be provided with the insert 2 or a correspondingly developed lavatory bowl, instead of the lavatory bowl 1, with which the pipeline 3 is connected.

The pipeline 3, through which the radioacitve urine is sucked off from the insert 2, leads to a reaction chamber 4. A first magnetic valve 5 and following a conveying pump 6 are disposed in the pipeline 3.

Furthermore, two containers 7 and 8, always for one reaction solution, which will be explained in more detail subsequently, are assigned to the reaction chamber 4, whereby each container 7, 8 is connected via an electrically controlled dosing apparatus, namely a metering pump 9 or 10 and a piece 11 or 12 of the pipeline with the inside of the reaction chamber 4.

In addition, the reaction chamber 4 is equipped with a levelsensor 13, an electrically controlled mixing and conveying pump 14. The level sensor 13 (feeler) scans the liquid level in the reaction chamber 4 and has been developed for producing an electric signal or a contact at a certain level of the liquid. Preferably, the feeler 13 is adjustable for several, say three levels of the liquid. The pump 14 has two temporarily separate functions: for one thing, it acts as a circulating pump for mixing of the react-on solutions delivered from the containers 7 and 8 into the urine located in the reaction chamber 4, and for another thing it conveys the mixed liquid into a pipeline 15 on the outlet side.

The reaction chamber 4 has an inside container wall 16 and an outside lead shielding 17 for the absorption of radioactive radiation.

A filtration unit 20, which in its inside has a compact, in the present example, hollow cylindrical filter body 21, which has a large surface and a porosity up to about 0.5 microns, is connected to the pipeline 15 on the outlet side in which a second magnetic valve 19 is disposed. The filtration unit 20 is likewise equipped with a lead shielding 22 for the absorption of the radioactive radiation. In order to be able to monitor the degree of contamination of the filtration unit 20, i. e., its filtration effect, a manometer 23 has been connected to the pipeline 15.

The filtration unit 20 has been arranged exchangeably and has been connected for this purpose with the pipeline 15 and a pipeline 24 on the output side by way of releasable connections 25, merely indicated in the drawing, which may be developed such that in case of release, they will block the pipelines 15 and 24. In order to avoid any danger of contamination in case of a replacement of the filtration unit, the possibility has been provided in case of the arrangement shown, of rinsing the filtration unit 20 through with tap water. For this purpose, the pipeline 15 is connected with a water main 27 by way of a manually operable valve 26. In addition, it will be effective, before replacement of the filtration unit 20, to empty the latter. For this purpose, a simple pipeline, not shown, may be provided between the filtration unit 20 and the reaction chamber 4. Alternatively, as shown in the drawing, the filtration unit 20 may be connected with the input side of the conveying pump 6 via a pipeline 28 and an additional magnetic valve 29 for sucking the liquid from said filtration unit, so that the liquid content of the filtration unit 20 may be pumped back into the reaction chamber 4.

The pipeline 24 of the filtration unit 20 on the output side is connected with a catch basin (tank) 31, which is equipped with a second level feeler 32 for scanning of the liquid level in the catch tank 31. A discharge pipeline 33 of the catch tank 31 is connected to the public canalization via an additional magnetic valve 34 acting as a discharge valve. Furthermore, a return pipeline 35 is connected to the discharge pipeline 33 before the magnetic valve 34, which is connected via a magnetic valve 36 with the conveying pump 6 on the input side.

In order to monitor the residual radioactivity of the liquid collected in the collecting tank 31, a radiation detector 37 has been disposed on the container 31, which is connected with a control monitor 38 the method of functioning of which will be described subsequently.

The present invention has a central, electric control unit 39, shown only schematically, which according to the subsequently described course of the process controls in accordance with a certain, partly adjustable program, and has for this purpose the indicated control lines 40 which are connected with the magnetic valves 5, 19, 29, 34 and 36, the conveying pump 6, the metering pumps 9 and 10, the mixing and conveying pump 14, the level feelers 13 and 32, and the control monitor 38. The control unit 39 may comprise especially a starter key with a control light for starting and signaling an automatic operation of the arrangement shown. Furthermore, an optical and possibly accustic recording of the response of the level feeler 13 of the reaction chamber 4, an adjusting organ for the adjustment of the level of response of the level feeler 13 in several steps, adjusting organs for the adjustment of the dosing quantities—brought about the by metering pumps 9 and 10 of the reaction solutions in the containers 7 and 8, an adjusting organ for the adjustment of the mixing period in the reaction chamber 4, i. e., of the operating period of the pump 14 as a mixing pump and an optical signal of the response of the level sensor 32 of the catch container 31. The control monitor 38 comprises effectively a recording instrument in order to record the radioactivity, measured by the radiation detector 37 as well as an optical and/or accustic alarm apparatus.

Electric control units, which are in a position to carry out a control program of the subsequently described type, and to deliver corresponding electric signals are known per se in numerous embodiments, for example, as a pure relay type control circuit with an electromechanical time signal transmitter as a fully electronic control circuit or else as a mixed control circuit.

The present process rests on the formation of an insoluble deposit (precipitate) between the iodide or iodade ions of the urine and the heavy metal cations of the heavy metal salt added to the urine in the reaction chamber, and the subsequent separation of the thus radioactive precipitate of the at least approximately not radioactive liquid through filtration by means of a compact filter. The formation of the radioactive precipitate is bolstered considerably by the addition of the carrier substance into the reaction chamber. In case the radioactive iodine is partly organically bound, as had already been mentioned, then an oxidation or reduction agent may be added additionally in a simple manner into the reaction chamber, for this purpose an additional container with metering pump has been provided for the reaction chamber 4 corresponding to the containers 7, 8 and the metering pumps 9, 10, and this additional metering pump is likewise connected in a corresponding manner to the central control unit 39.

A solution of potassium iodide, sodium iodide, silver iodide or silver chloride can be added, for example, to the urine as a carrier substance in the reaction chamber and may be mixed with it. Subsequently, the solution of a silver salt (for example, silver nitrate, silver actate, silver fluoride, silver chloride) or a corresponding mercury salt may be added, for example, to this reaction liquid as a heavy metal salt, and may be mixed with the reaction liquid. At the same time, an insoluble, radioactive precipitate develops from the radioactive iodine, the carrier substance and the heavy metal salt, as well as other amiones (phosphates, sulphates, chlorides) present in the urine, which (precipitate) may be separated, as a suspension present in the urine, in the series connected filtration unit from inactive or very slightly radioactive urine. Instead of reaction solutions, one may also use microsuspensions.

As oxidation or reduction agent for organically bound radioactive iodine, one may use, among others for example potassium permanganate or trichloride.

The following examples will illustrate the formation of the radioactive precipitate.

EXAMPLE 1

About 1 ml 10% potassium iodide solution is put into the reaction chamber 4 containing the urine, from the container 7 via the metering pump 9. After about 9 seconds of stirring with the mixing pump 14, 1 ml 15% silver acetate solution is added into the reaction chamber from the container 8 via the metering pump 10, whereupon stirring is continued for about 1 minute. After this reaction time the developing suspension is pumped onto the filtration unit.

EXAMPLE 2

After the addition of the potassium iodide solution according to Example 1, an aqueous silver chloride micro suspension (1 g in 2 ml of water) is added from the container 8 via the metering pump 10 and is stirred after 1 minute, additionally 1 ml of 10% silver nitrate solution is still added automatically from an additional container via an additional metering pump. After one minute of further stirring, the suspension is pumped into the filtration unit.

EXAMPLE 3

After the addition of the potassium iodide solution as in Example 1, 1 ml of 10% silver fluoride solution is added from the container 8 via the metering pump 10 and is stirred for about one minute, whereupon the suspension is pumped into the filtration unit.

Subsequently, the method of functioning of the arrangement shown in the drawing is described on the basis of a control program of the central control unit. This control program comprises, for example, the following steps and effects:

(1) Pressing down of a starter key

The pressing down of a starter key not shown in the drawing is the sole manual operation which is needed in order to start the apparatus. Prior to pressing down of the starter key, the level sensor 13 is set for the desired liquid level, at which it is to respond, in the control unit 39 the metering quantities of the metering pumps 9 and 10 as well as the mixing period of the combined mixing and conveying pump 14 are set.

Upon depressing of the starting key, a control lamp "operation", not shown either in the drawing, lights up.

(2) Pumping out of the urine

After depressing the starter key, a control signal of the control unit starts the conveying pump 6 and an additional control signal energizes the magnetic valve 5. As a result, the radioactive urine is moved out of the insert 2 via the volumetrically operating pump 6 into the reaction chamber 4.

(3) Level control in the reaction chamber

Whenever the level sensor 13 responds after a certain time determined in the control unit 39, then the operating state of the arrangement is ended automatically and particularly conveying pump 6 and the magnetic valve 5 are disconnected. It will then have to be checked whether there is any urine at all that is to be treated and may be whether the level sensor 13 is to be adjusted deeper.

Whenever, on the other hand, the level sensor 13 responds, which is recorded optically or optically and acoustically by the control unit 39, said control unit 39 will switch on the adding and mixing process with a certain delay as follows, after it had first disconnected the conveying pump 6 and the magnetic valve 5.

(4) Mixing

The pump 14 is switched on in the mode of operation as a circulating pump by a control signal of the control unit. Another control signal switches the metering pump 9 on during a time determined by the value of the dosing quantity set, so that the desired quantity of the carrier substance solution in the container 7 reaches the reaction chamber 4 and is intermixed there with the radioactive urine. A subsequent control signal turns on the metering pump 10 during a certain time, so that the desired quantity of the heavy metal salt solution reaches the reaction chamber 4. After switching the metering pump 10 off, the mixing pump 14 remains switched on.

(5) Conveying

After expiration of the pre-set mixing time, a control signal of the control unit 39 switches the pump 14 over into the mode of operation as a pressure pump, while an additional control signal energizes the magnetic valve 19. As a result, the content of the reaction chamber 4 (suspension of the radioactive precipitate in the urine) is pumped to the filtration unit 20, where the radioactive precipitate will remain in the outside layers of the filtering body 21, the at least approximately inactive urine flows through the filtering body and reaches the catch container 31 via the pipeline 24. The correct functioning of the filtration unit 20 may be checked by way of the manometer 23, by announcing (showing) a plugging up of filtration body 21 by a rise in pressure.

(6) Control of the residual activity and control of the catch (collecting) container The radioactivity of the urine flowing into the catch container 31 is measured continuously by the radiation detector 37 and is evaluated in the control monitor 38.

Whenever the radioactivity of the urine lies above a permissible (safe) limit, for example, as a result of a failure of some part of the arrangement, then the control monitor 38 triggers an optical and/or acoustic alarm. At the same time, control signals of the control monitor 38 or of the control unit 39 again switches the conveying pump 6 on and energize the magnetic valve 36, so that the radioactive urine is pumped back from the catch container 31 via the pipeline 35 into the reaction chamber 4.

If, on the contrary, the radioactivity of the urine in the catch container 31 is within the permissible range, then the catch container is filled until the level sensor 32 responds. The latter triggers a control signal in the control unit 39, which energizes the magnetic valve 34, so that the unobjectionable urine may flow into the canalization via the discharge pipeline 33. The response of the level sensor 32 is best indicated optically, so that there is an optical control of the methodical removal of the radioactive iodine from the urine and of the discharge of the inactive urine into the canalization.

After draining of the catch container 31, the control unit 39 switches all mentioned apparatuses into the state of rest, so that the control light "operation" is extinguished.

The replacement (exchange) of the filtration unit 20 may be accomplished manually without difficulty, quickly and above all without danger of contamination. By manual operation of the valve 26, the filtration unit 20 is first flushed with tap water, whereupon the residual water, which might still possibly be radioactive, is pumped via the pipeline 28 and the magnetic valve 29 or a corresponding hand valve by means of the conveying pump into the reaction chamber. Then the filtration unit 20 may be detached from its connections 25 and, because of its lead shielding be moved in a radiation safe manner into a fadeaway chamber, or else into a special processing chamber, in which the radioactive precipitate is removed from the filtration body 21, for example, by sucking-off, and is then kept in a radiation safe manner until the radioactivity has faded away.

Instead of starting the apparatus described, by pressing down a starting key, this may also be accomplished automatically for example by an electric contact built into the seat of the lavatory bowl, so that any running over of the insert 2 is made impossible, because the urine collected in the insert is sucked off immediately.

With the present process and the present invention, radioactive iodine cannot only be removed automatically from urine, but also from other liquids, in order to avoid the discharge of radioactive contaminations into the canalization. It is also possible to remove other radioactive substances automatically from liquids with this process and the invention, using the corresponding reaction solutions.

What is claimed is:

1. An apparatus for the removal of radioactive iodine from a patient's urine comprising:

(A) means in a lavatory for collecting the patient's urine said means being provided with an outlet line arranged for removing the urine free from solids;

(B) a reaction chamber having an inlet line and an outlet line;

(C) a pump and a first magnetic valve connected in series between the outlet line of said collecting means and the inlet line of said reaction chamber;

(D) a level sensor for said reaction chamber;

(E) at least two containers for reaction solutions having means for supplying a dosed quantity of said reaction solutions to said reaction chamber, said means including an electrically operating metering pump in an outlet line of each container;

(F) a mixing apparatus in said reaction chamber for mixing of said urine and said quantities of reaction solutions;

(G) a pressure pump in said reaction chamber for the conveyance of the mixed liquid from said reaction chamber through its outlet line;

(H) a filtration unit connected releasably to said outlet line of said reaction chamber via a second magnetic valve, said filtration unit having at least one outlet line;

(I) a catch container having an inlet line releasably connected to said one outlet line of said filtration unit and having at least one outlet line, said one outlet line of said catch container being connectable via a third magnetic valve with a canalization system;

(J) an electric control unit having at least one control inut connected with said level sensor in said reaction chamber and a plurality of control outputs connected with, respectively, with said pump in said outlet line of said collecting means, said first, second and third magnetic valves, said metering pumps, said mixing apparatus and said pressure pump in said reaction chamber; and (K) a radioactive radiation detector disposed on said catch container with a control monitor connector thereto, said control monitor being adapted to open said third magnetic valve according to the quantity of liquid in said catch container and to close said third magnetic valve in case of a rise of the measured radioactivity of said quantity of liquid in said catch container beyond a certain permissible value.

2. The apparatus as claimed in claim 1, characterized in that said means for collecting the patient's urine comprises an insert insertable in the bowl of a lavatory and covering up the front part of said bowl.

3. The apparatus as claimed in claim 1, characterized in that said mixing apparatus and pressure pump comprises an electrically operable apparatus, convertible electrically as a circulating and as a pressure pump.

4. The apparatus as claimed in claim 1, characterized in that the filtration unit contains a compact exchangeable filter with a pore-width up to 0.5 microns.

5. The apparatus as claimed in claim 1, characterized in that a manometer for monitoring the flow of the liquid through the filtration unit, is connected to the line leading to said filtration unit.

6. The apparatus as claimed in claim 1, characterized in that the line leading to the filtration unit is connected with a water main via a valve, in order to be able to flush the filter of the filtration unit prior to its being exchanged.

7. The apparatus as claimed in claim 1, characterized in that the filtration unit is connected with the reaction chamber via a second line, in order to be able to move the liquid located in the filtration unit into the reaction chamber, prior to exchange of its filter.

8. The apparatus as claimed in claim 1, characterized in that the reaction chamber and the filtration unit are provided with a lead shielding for the absorption of radioactive radiation.

9. The apparatus as claimed in claim 1, characterized in that the catch container is provided with a second level sensor.

10. The apparatus as claimed in claim 1, wherein a second outlet of said catch container is connected via a return line with said reaction chamber, a fourth magnetic valve being disposed in said return line, said fourth magnetic valve being adapted to be electrically controlled by said control monitor in such manner that said fourth magnetic valve is opened and said catch container is emptied into said reaction chamber whenever the measured radioactivity of the liquid in said catch container rises beyond said certain permissible value.

* * * * *